US011026452B2

(12) United States Patent
Richmond et al.

(10) Patent No.: US 11,026,452 B2
(45) Date of Patent: Jun. 8, 2021

(54) SYSTEM FOR EXTRUDING AND HEATING VAPORIZABLE MATERIAL CONCENTRATES

(71) Applicant: Banana Bros, LLC, Culver City, CA (US)

(72) Inventors: David Richmond, Culver City, CA (US); Howard Richmond, Los Angeles, CA (US); Manuel A. Montano, Gardena, CA (US); Jeffery Kunkler, Culver City, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 16/052,885

(22) Filed: Aug. 2, 2018

(65) Prior Publication Data

US 2020/0037662 A1 Feb. 6, 2020

(51) Int. Cl.

| | |
|---|---|
| ***A24F 7/02*** | (2006.01) |
| ***H05B 3/22*** | (2006.01) |
| ***A24D 1/14*** | (2006.01) |
| ***A24B 15/167*** | (2020.01) |
| ***A24F 47/00*** | (2020.01) |

(52) U.S. Cl.

CPC ..... *A24F 47/008* (2013.01); *A24B 15/167* (2016.11); *A24D 1/14* (2013.01); *A24F 7/02* (2013.01); *H05B 3/22* (2013.01)

(58) Field of Classification Search

CPC ..... A24F 47/008
USPC ..... 131/328
See application file for complete search history.

(56) References Cited

U.S. PATENT DOCUMENTS

| | | | | |
|---|---|---|---|---|
| 2014/0261483 | A1* | 9/2014 | Hopps | A24F 47/002 131/298 |
| 2014/0283855 | A1* | 9/2014 | Hawes | A24F 47/008 131/328 |
| 2015/0223520 | A1* | 8/2015 | Phillips | A61M 15/06 131/328 |
| 2017/0231283 | A1* | 8/2017 | Gadas | A24F 7/02 131/329 |

* cited by examiner

*Primary Examiner* — Eric Yaary
*Assistant Examiner* — Jennifer A Kessie
(74) *Attorney, Agent, or Firm* — Smyrski Law Group, A P.C.

(57) ABSTRACT

A vaporizer is provided, including a body, a concentrate chamber provided within the body and including at least one chamber aperture, a concentrate pusher configured to push material through the concentrate chamber, a heating element having at least one element aperture, the heating element positioned proximate the at least one chamber aperture and configured to heat material pushed through the concentrate chamber, and a power source configured to apply power to the heating element.

20 Claims, 6 Drawing Sheets

SYSTEM FOR EXTRUDING AND HEATING VAPORIZABLE MATERIAL CONCENTRATES

BACKGROUND

I. Field

The present disclosure relates generally to the field of vaporizers, and more particularly, to vaporizers utilizing plant material extracts.

II. Background

Plants are capable of synthesizing chemical compounds that benefit an individual plant in many ways, including for use as energy sources, for use as reactants in biological reactions, for defense against certain insects and animals, and to attract other insects or animals that are beneficial to the plant.

Many of the chemical compounds synthesized by plants have been found to have favorable or beneficial effects when consumed by humans. These effects can be either short-term or long-term, and they may impact a human's health, mental state, or both. As a result, humans have adopted the consumption of plant-synthesized chemical compounds (also known as "phytochemicals") for both medicinal and recreational purposes.

As a means for consuming phytochemicals, humans adopted the practice of smoking, where a substance containing phytochemicals, such as tobacco, is burned in a way that the resulting smoke may be inhaled or tasted. Released with the smoke and subsequently inhaled or tasted by the smoker are phytochemicals, such as nicotine, that enter the body of the smoker. Recently, however, smoke inhalation has become associated with a detrimental impact on a smoker's health. As a result, smokeless alternatives to smoking have become more popular in society.

A popular alternative to smoking is the use of vaporizers. Vaporizers work by heating a substance to a temperature sufficient to cause the release of chemicals within the substance without burning or combusting the substance. Using a substance containing phytochemicals in a vaporizer allows users to taste or inhale the released phytochemicals without inhaling any smoke, enabling users to achieve effects similar those achieved by smoking without being subjected to the negative consequences of smoke inhalation.

Vaporizers have been designed to accommodate a wide variety of substances, including plant matter and plant matter extracts. Plant matter extracts are available in both a solid state, such as a wax, or in liquid states of various viscosities, such as oils. Some vaporizers are designed so that a user may add plant matter and/or plant matter extracts into the vaporizer as needed, however, handling plant matter or plant matter extracts is both messy and inconvenient. Alternative designs accept cartridges that are pre-filled with plant matter extracts for a cleaner and more efficient experience.

Current vaporizer designs typically use conduction to heat and vaporize substances. A heating element, such as a heating coil or a flameless wick, is often used to achieve conduction, which is often in direct contact with the substance to be vaporized. However, due to the limited surface area of many heating elements, heat is often unevenly distributed across the substance being vaporized. This uneven heat distribution results in substance residue that is either wasted because it cannot be heated sufficiently for vaporization, or hardens and "bakes on" to vaporizer components.

Alternatively, some vaporizer designs utilize convection or a combination of convection and conduction to heat and vaporize substances. Convection and convection-conduction designs provide for more even heat distribution compared to conduction-only designs, but they also have their drawbacks. For example, convection and convection-conduction designs are still subject to substance residue hardening and "baking on" to vaporizer components. This is due in part to a constant amount of heat being applied to a substance with a volume that continually decreases throughout the vaporization process, and also because heat is applied unevenly throughout the substance being vaporized. Additionally, uneven heat distribution and a constantly changing substance volume create difficulties for users seeking a more consistent and predictable dose of phytochemicals with each inhalation.

It would, therefore, be beneficial to provide a vaporizer that reduces the amount of substance residue produced by vaporization, and that enables users to consume a more consistent dosage of phytochemicals from plant material extracts.

SUMMARY

Thus according to the present design, there is provided a vaporizer, comprising a body, a concentrate chamber provided within the body and comprising at least one chamber aperture, a concentrate pusher configured to push material through the concentrate chamber, a heating element comprising at least one element aperture, the heating element positioned proximate the at least one chamber aperture and configured to heat material pushed through the concentrate chamber, and a power source configured to apply power to the heating element. The apparatus may include a printed circuit board (PCB) configured to control electricity provided between the power source and the heating element, an element gap formed between the heating element and the concentrate chamber, wherein an air passage is formed within the body enabling the user to draw vapor, gas, or aerosol via a mouthpiece provided with the body. The apparatus comprises a power switch configured to effectuate application of electrical power to the heating element. The body may comprise detachable pieces, the concentrate chamber may be provided in a replaceable cartridge. The heating element may be attached to a spring configured to increase distance between the heating element and chamber aperture when pressure is applied to the heating element, at least one chamber aperture comprises a one-way valve, and pressure may be applied to the concentrate pusher by twisting a knob on the apparatus. The heating element may be formed of high-temperature glass coated with a material that converts electrical energy into heat. The material that converts electrical energy into heat may comprise carbon nanotubes or graphene or other material performing this function.

According to a second embodiment, there is provided a method comprising applying pressure to a concentrate pusher to move vaporizable material concentrate from a concentrate chamber through a chamber aperture in a body of a vaporizer toward a heating element; and activating the heating element to heat the vaporizable material concentrate.

According to a further embodiment, there is provided a vaporizer comprising a concentrate pusher configured to push material through a concentrate chamber provided within a vaporizer body, a heating element positioned proximate the concentrate chamber and configured to heat material pushed through the concentrate chamber, and a power source configured to apply power to the heating element.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
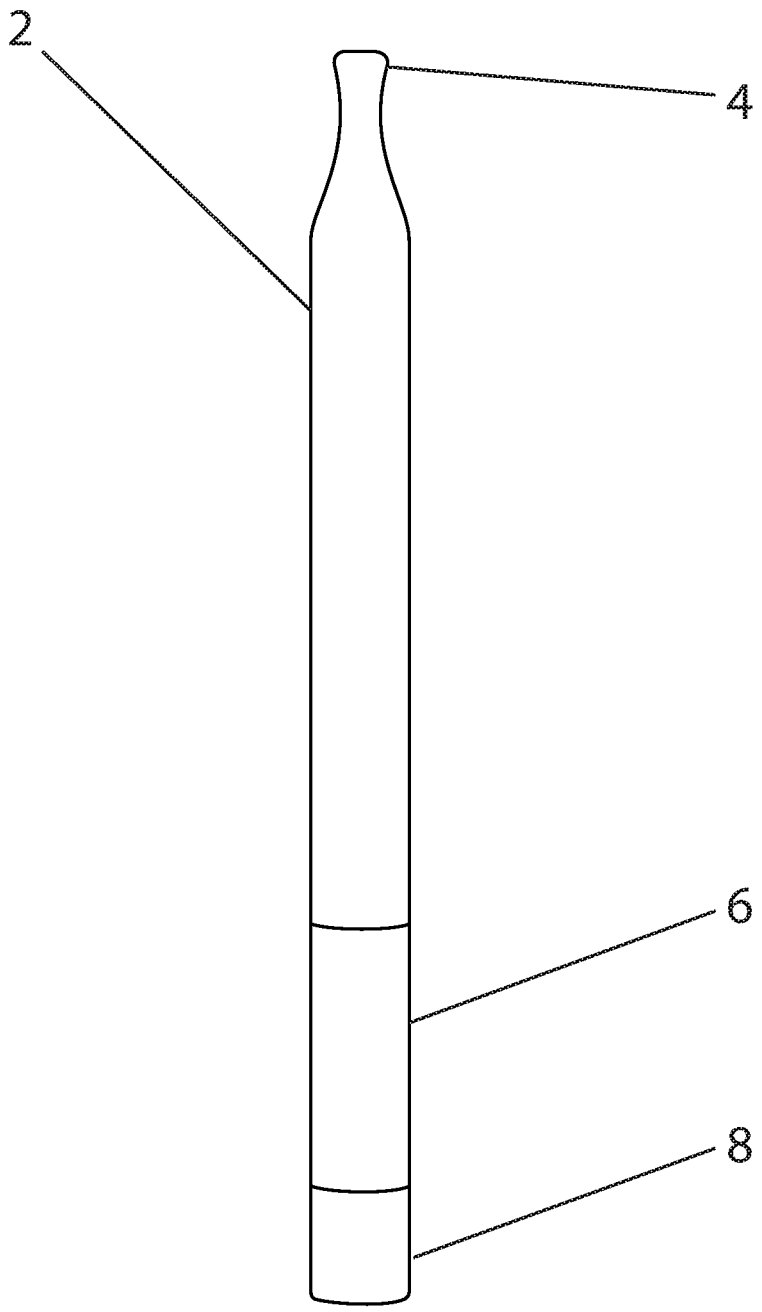
FIG. 1 illustrates a front orthogonal view of one embodiment of the present design.
Figure 2:
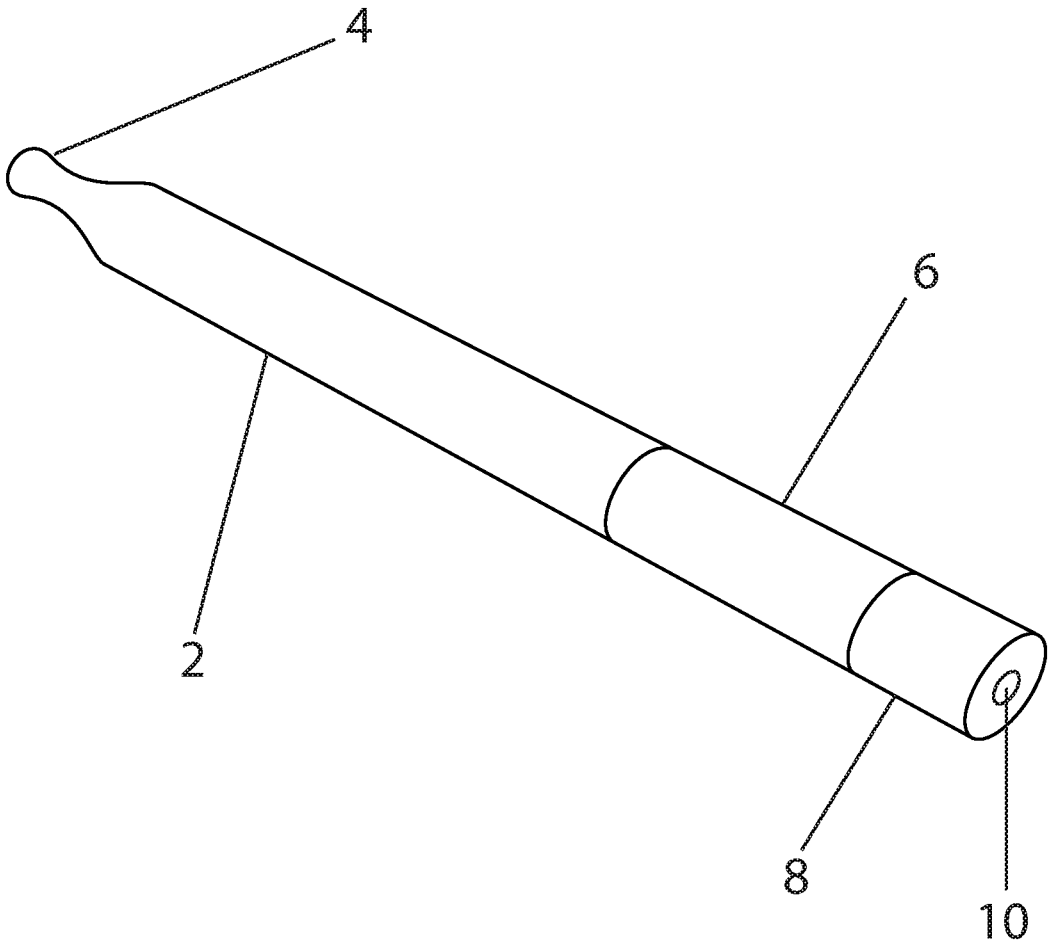
FIG. 2 illustrates a perspective view of one embodiment of the present design.

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used herein, the term "comprise" and variations of the term, such as "comprising" and "comprises," are not intended to exclude other additives, components, integers or steps.

As used herein, "air channel" means the channel or aggregate of channels that enable air to flow into one aperture of the design and out a different aperture.

"Vaporizable material concentrate" means a solid, semi-solid, or liquid concentrate capable of being vaporized or converted into a gas or an aerosol when heated, such as a wax or oil extracted from tobacco, cannabis, or other organic matter.

"Concentrate chamber" means a chamber in which vaporizable material concentrate is contained.

"Concentrate pusher" means a component used to move vaporizable material concentrate out of the concentrate chamber.

"Chamber aperture" means an opening, hole, or gap in the concentrate chamber through which vaporizable material concentrate may be expelled when moved by a concentrate pusher.

"Heating element" means a disk-shaped component capable of emitting enough heat to convert vaporizable material concentrate into vapor, gas, or aerosol;

"Element gap" means the space between a concentrate chamber and a heating element;

"Element aperture" means an opening, hole, or gap in the heating element through which vaporizable material concentrate, vapor, gas, or aerosol may pass from the element gap through the heating element.

"PCB" means a printed circuit board used to support and electrically connect electronic or electrical components within the design.

"Power source" means a battery or other means for supplying the components within the design with electrical energy.

"Power switch" means a component such as a button or a switch that completes an electrical circuit within the design when turned on.

A system for extruding and vaporizing organic matter concentrates comprised of an outer body, an air channel, and various components. Concentrates are extruded from within a chamber housed in the system and are placed into proximity to a perforated, disk-shaped, electrical heating element that distributes heat evenly across its surface. The concentrates are vaporized when in contact with or proximity to the heating element, and a user may inhale the resulting vapor by drawing air through the system, through the air channel, and through the heating element.

The present design thus is an apparatus that can be portable and held in a user's hand. The apparatus includes a mouthpiece and a main body within which the apparatus components are housed. Vaporizable material concentrate is contained in a chamber or a plurality of chambers referred to herein as concentrate chambers, and the apparatus enables a user to move an amount of vaporizable material concentrate into contact or close proximity to a heating element where it can be converted into vapor, gas, or aerosol.

Users draw air through the device by sucking or inhaling from the device mouthpiece. When done, air is pulled into an air intake aperture at the distal end of the device, through a channel or a plurality of channels in the device and past vaporizable material concentrate heated by device components, and, finally, into the user's mouth through an aperture in the mouthpiece.

Vaporizable material concentrate can be housed within the apparatus within a concentrate chamber or a plurality of concentrate chambers accompanied by little or no air. Vaporizable material concentrate can be moved through a concentrate chamber using a concentrate pusher capable of a piston-like effect. The concentrate pusher displaces vaporizable material concentrate from a concentrate chamber through a chamber aperture or a plurality of chamber apertures.

Users may control the movement of concentrate pushers. A concentrate pusher may be manual or powered. When manual, a user may twist an outer wheel or knob on the outside of the device that turns a device such as a screw, for example, within the apparatus. When twisted, threads of the screw move the concentrate pushers in a manner comparable to the movement of glue through a glue stick. The device may alternately be equipped with a button that slides along the outer body of the apparatus that moves concentrate pushers within the apparatus when slid by a user, or any other mechanism that allows a user to apply pressure to a concentrate pusher within the apparatus. When powered, the user may activate a power source by pressing a button, flipping a switch, or similar means, powering a motor that applies pressure to and causes the movement of apparatus concentrate pushers.

Concentrate chambers may be housed in cartridges that can be removed from the device for cleaning or filled with vaporizable material concentrate. Concentrate chamber cartridges may also be disposable and replaced with pre-filled cartridges.

When vaporizable material concentrate is displaced from concentrate chambers by concentrate pushers, an amount of vaporizable material concentrate may exit the concentrate chambers through chamber apertures. Chamber apertures may allow for two-way movement in or out of concentrate chambers, or they may prevent vaporizable material concentrate from re-entering concentrate chambers, such as by being molded as or equipped with septum valves, umbrella valves, or other one-way valves.

Once vaporizable material concentrate is extruded from a concentrate chamber, the extruded material is in close proximity to or in direct contact with a heating element. The heating element may be disk-like in shape, connected to a power source, and comprised of high-temperature resistant material, such as glass, coated with a material capable of converting electrical energy into heat, such as electrically conducting carbon nanotubes or graphene. The heating element emits a sufficient amount of heat to convert vaporizable material concentrate into vapor, gas, or aerosol when in close proximity to or direct contact with the heating element. The disk-like shape of the heating element produces an even distribution of heat across the surface of the heating element and allows for a greater surface area with which vaporizable material concentrate may come into contact. In alternative embodiments, the heating element may be a disk or plate made out of a heat-conducting material containing metal heating elements, ceramic heating elements, polymer PCT heating elements, composite heating elements, or combination heating element systems.

A gap, referred to herein as an element gap, may be maintained between the chamber aperture(s) and heating element to allow air to pass through the device to mix with vapor, gas, or aerosol produced from vaporizable material concentrate, creating a less harsh and more pleasurable experience for the user. Ideally, the element gap is maintained at a fixed distance, for example approximately 0.8 mm, between the chamber aperture(s) and heating element; however, element gap distance may be adjustable, and the heating element may be equipped with a spring so that the heating element may adapt to a particular volume of vaporizable material concentrate within the element gap.

The heating element may include an element aperture or a plurality of element apertures that allow vapor, gas, or aerosol to pass from the element gap and into an air channel so that a user may consume the vapor, gas, or aerosol.

The heating element and other device components are powered by a power source such as a battery. A printed circuit board (PCB) may be used to support and electrically connect any electronic or electrical components within the apparatus, and the electrical circuit within the apparatus may be turned on by a button or a switch on the body of the device, or by a switch that is engaged by air pressure within the device.

When used correctly, a user may convert the desired amount of vaporizable material concentrate into vapor, gas, or aerosol by using a concentrate pusher to extrude it from a concentrate chamber and into close proximity to or contact with an activated heating element. The user may then inhale the resulting vapor, gas, or aerosol by drawing air from the mouthpiece. Air enters the air intake aperture, flows through the air channels, mixes with the vapor, gas, or aerosol in the element gap, continues through element apertures air channels, and finally into the user's mouth from the mouthpiece aperture.

Thus the present design can quickly produce vapor, aerosol, or gas from vaporizable material concentrate, reduce the waste of vaporizable material concentrate by distributing heat evenly and increasing contact with vaporizable material concentrate, increasing user satisfaction, minimize substance residue and "baking on" issues, enable users to control the amount of vaporizable material concentrate with greater precision than with other devices, and reduce the likelihood of leaks or spills by containing vaporizable material concentrate in self-sealing chambers with little to no air.

In general, with regard to FIGS. 1-6, an apparatus can comprise a main body 2 with a mouthpiece 4 and a mouthpiece aperture 11, component housing 6, an adjustment knob 8, and an air intake aperture 10. The internal components of the apparatus comprise a power source 12, a PCB 13, a power switch 23, a heating element 14 with element apertures 25, an extruding ram 16, a concentrate pusher 17, an element gap 19, an element spring 20, an air channel 21, and a concentrate cartridge 22 with concentrate chambers 15 containing vaporizable material concentrate 18 and chamber apertures 24. In this arrangement, vaporizable material concentrate 18 is provided in concentrate chambers 15.

With reference to FIGS. 1 to 6, the apparatus can be used to quickly and effectively convert vaporizable material concentrate 18 into vapor, gas, or aerosol for consumption by its user. The apparatus can be portable and is preferably sized to be held in a user's hand.

A main body 2 provides the main shape of the apparatus. The main body 2 can take any shape and can be made out of any rigid material, such as, for example, plastic, glass, or metal. Part or all of the main body 2 can be transparent or translucent such that the internal contents of the apparatus are visible. The main body 2 of the apparatus may be one piece of material, or separate and distinct parts, such as a mouthpiece 4, a component housing 6 section and functional components such as an adjustment knob 8 and a power switch 23.

Figure 3:
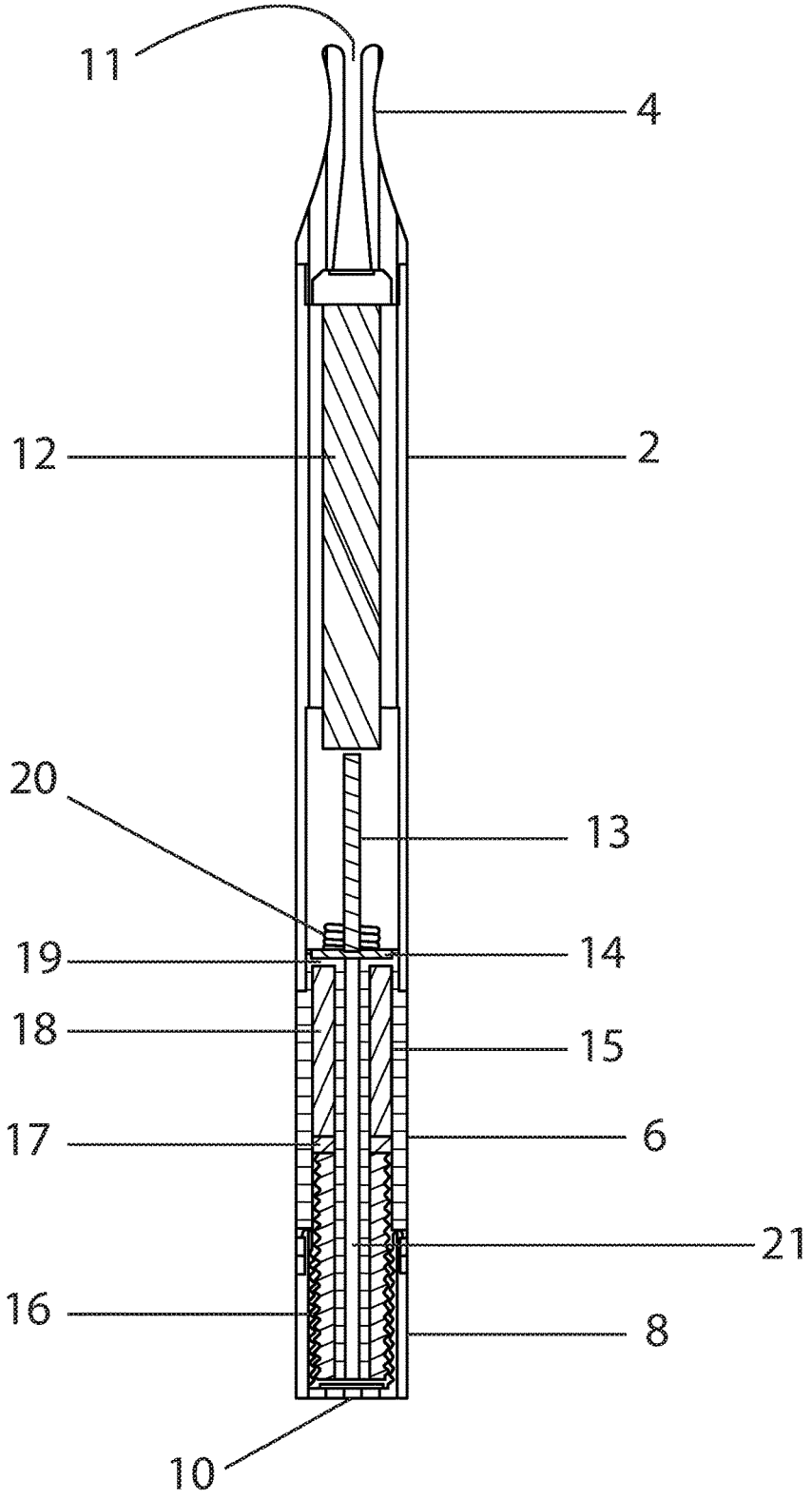
FIG. 3 illustrates a front sectional view of one embodiment of the present design.
Figure 4:
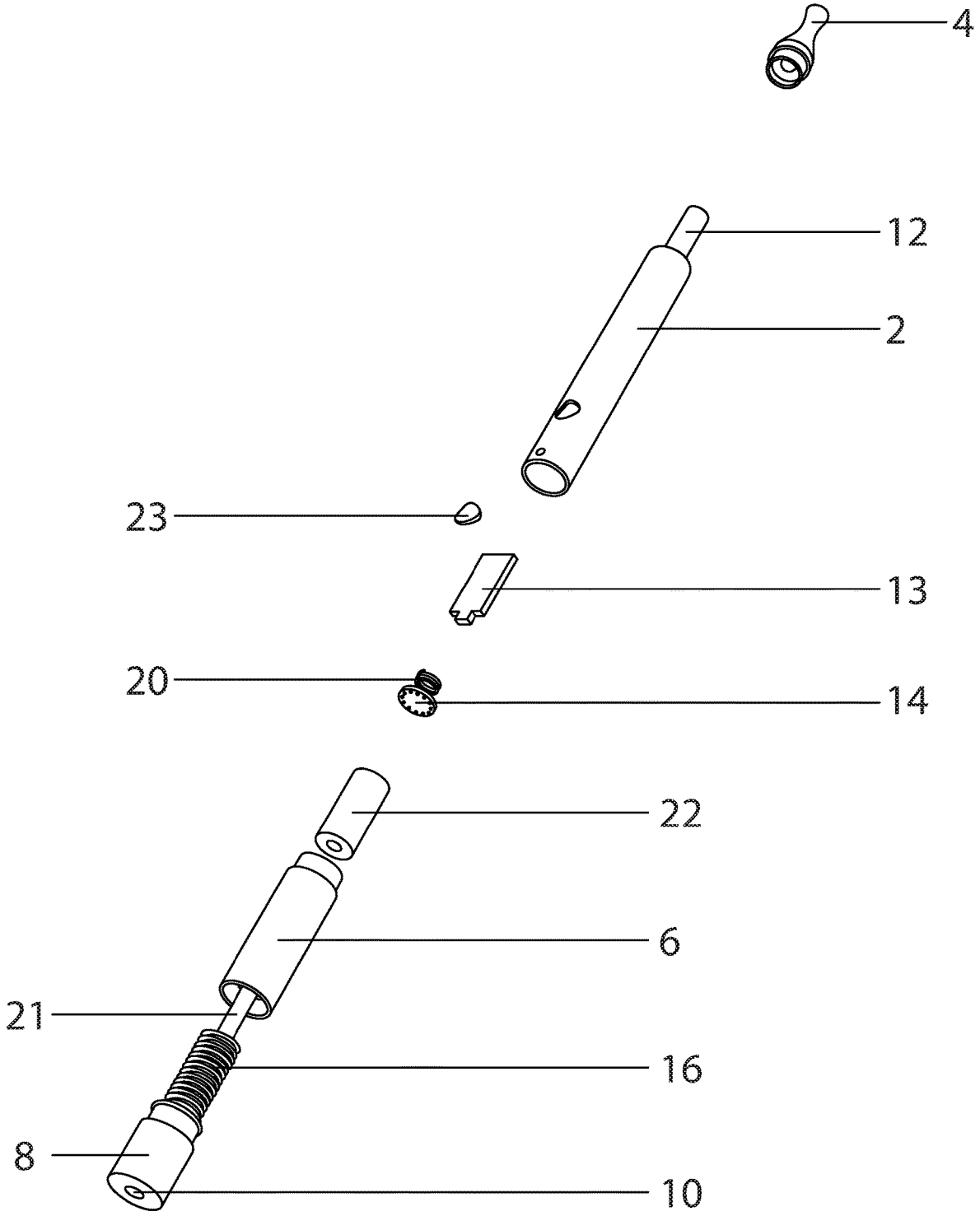
FIG. 4 illustrates an exploded perspective view of one embodiment of the present design.

As shown in FIGS. 1-5, the device includes an air intake aperture 10, as well as an air channel 21 and mouthpiece aperture 11 shown in FIGS. 3-6. As illustrated in FIG. 4, air can be drawn into the device through the air intake aperture 10, through the air channel 21, past the device's internal components, and out through the mouthpiece aperture 11 of the mouthpiece 4.

Figure 5:
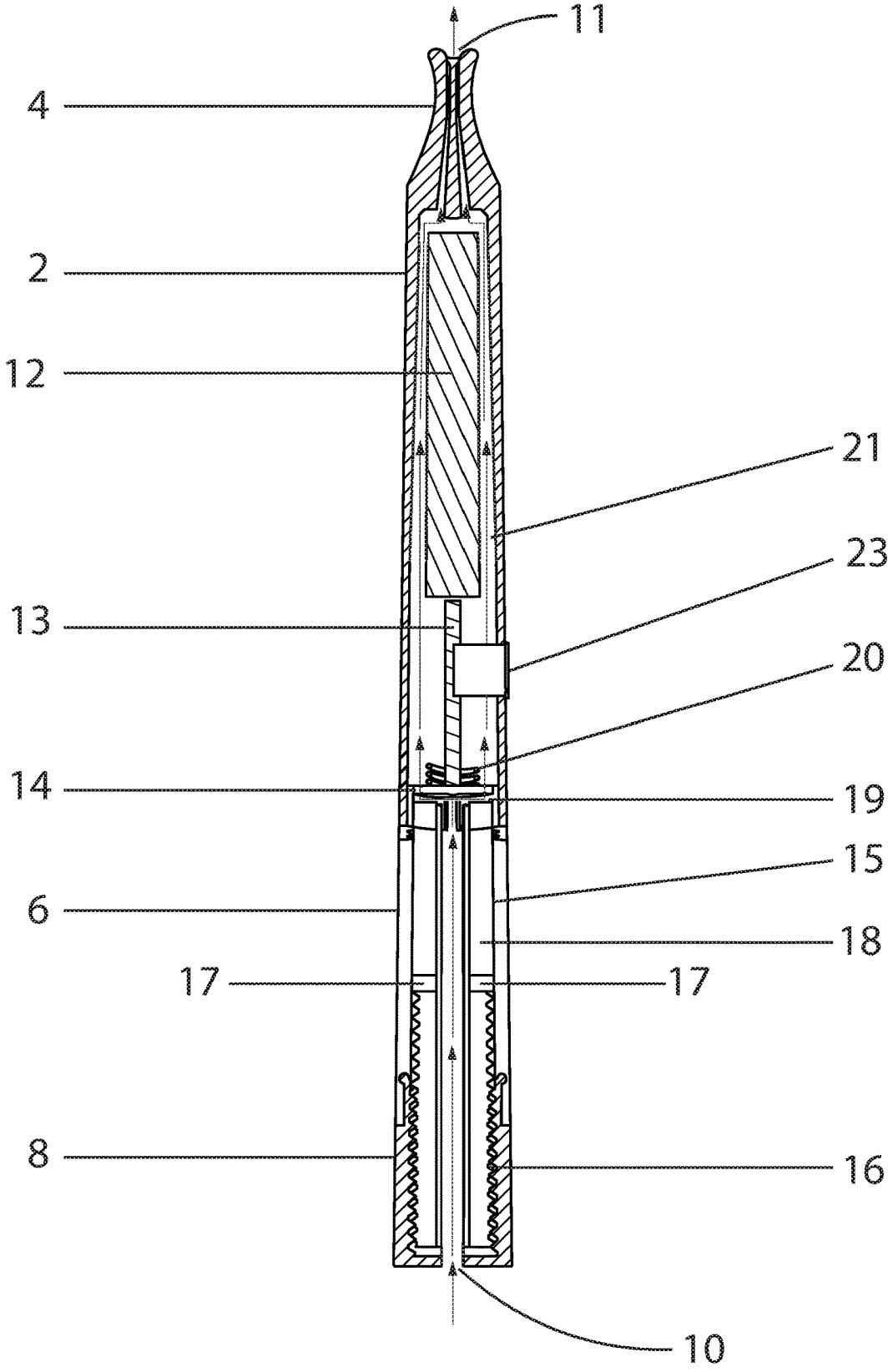
FIG. 5 is a front sectional view illustrating airflow through one embodiment of the present design.

As seen in FIGS. 3-5, the device comprises a power source 12, such as a battery, that supplies electricity to a heating element 14. A printed circuit board or PCB 13 may be used to support and electrically connect any electronic or electrical components within the apparatus, and the electrical circuit within the apparatus may be turned on by power switch 23 or by a switch engaged by air pressure within the device. The PCB 13 may effectuate power from power source 12 to the heating element 14, promoting an even burn with little material loss or material buildup. The heating element 14 is in proximity to a concentrate chamber 15 containing vaporizable material concentrate 18. The heating element 14 may be equipped with a spring 20 for adjusting the distance between the heating element 14 and the concentrate chamber 15.

A user may convert vaporizable material concentrate 18 into vapor, gas, or aerosol, by moving vaporizable material concentrate 18 out of concentrate chamber 15 and displacing the vaporizable material concentrate 18 with a concentrate pusher 17. A concentrate pusher 17 may be moved manually or mechanically. To move manually, a user may twist an outer wheel or adjustment knob 8 on the outside of the device that turns a screw or extruding ram 16 within the apparatus. When twisted, the threads of the screw or extruding ram 16 move the concentrate pushers 17 in a manner comparable to the movement of glue through a glue stick. The device may alternatively be equipped with a button that slides along the outer body of the apparatus that moves concentrate pushers 17 within the apparatus when slid by a user, or any other mechanism that allows a user to apply pressure to a concentrate pusher 17 within the apparatus. When powered, the user may activate a power source by pressing a button, flipping a switch, or using any other device or devices to power a motor that applies pressure to and causes the movement of apparatus concentrate pushers 17.

Figure 6:
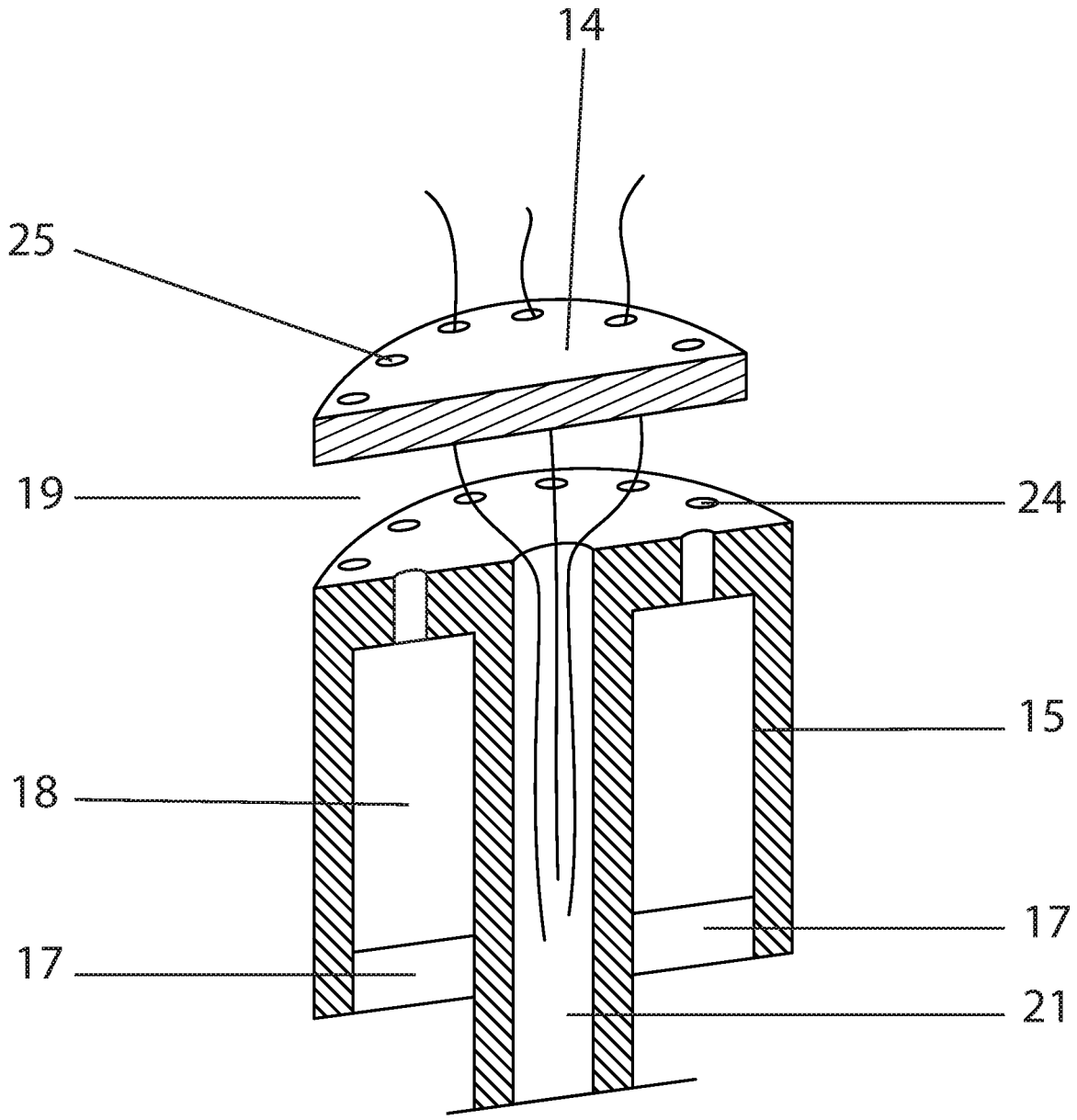
FIG. 6 illustrates a sectional view of a suggested arrangement of internal components within the present design.

As shown in FIG. 6, concentrate pushers 17 abut vaporizable material concentrate 18 contained within a concentrate chamber 15. When pressure is applied to a concentrate pusher 17, vaporizable material concentrate 18 exits the concentrate chamber 15 through chamber apertures 24. Chamber apertures 24 may allow for two-way movement in or out of concentrate chambers 15, or they may prevent vaporizable material concentrate 18 from re-entering concentrate chambers 15, such as by being molded as or equipped with septum valves, umbrella valves, or other one-way valves.

Vaporizable material concentrate 18 extruded through chamber apertures 24 may be extruded into an element gap 19 and in proximity to a heating element 14 containing element apertures 25. When activated, the heating element 14 converts the extruded vaporizable material concentrate 18 into vapor, gas, or aerosol. Air drawn through the Air Chamber 21 mixes with the converted vaporizable material concentrate 18 in the element gap 19, and the mixture of air and converted vaporizable material concentrate 18 flows through element apertures 25 of the heating element 14 and then again through the air channel 21 of the device.

The heating element 14 may be disk-like in shape and comprised of high-temperature resistant material, such as glass, coated with a material capable of converting electrical energy into heat, such as electrically conducting carbon nanotubes or graphene. Any viable material that converts electrical energy into heat may be employed. The heating element 14 emits a sufficient amount of heat to convert vaporizable material concentrate 18 into vapor, gas, or aerosol when in proximity to or in direct contact with the heating element 14. The disk-like shape of the heating element 14 produces an even distribution of heat across the surface of the heating element 14 and allows for a greater surface area with which vaporizable material concentrate 18 may come into contact. In alternative embodiments, the heating element 14 may be a disk or plate made out of a heat-conducting material containing metal heating elements, ceramic heating elements, polymer PCT heating elements, composite heating elements, or combination heating element systems.

The element gap 19 may be maintained between the chamber aperture(s) 24 and heating element 14 to allow for air passing through the device to mix with vapor, gas, or aerosol produced from vaporizable material concentrate 18. Ideally, the element gap 19 is maintained at a relatively small distance, typically between 0.5 and 1.0 mm but in one embodiment approximately or exactly 0.8 mm, between the chamber aperture(s) 24 and heating element 14. The element gap 19 distance may be adjustable.

When used correctly, a user may convert the desired amount of vaporizable material concentrate 18 into vapor, gas, or aerosol by using a concentrate pusher 17 to extrude the vapor, gas, or aerosol from a concentrate chamber 15 and into proximity to or contact with an activated heating element 14. The user may then inhale the resulting vapor, gas, or aerosol by drawing air from the mouthpiece 4. As shown in FIG. 4, air enters the air intake aperture 10, flows through the air channels 21 where it mixes with the vapor, gas, or aerosol in the element gap 19, continues through heating element 14 the air channels 21, and finally into the user's mouth from the mouthpiece aperture 11.

Notable in the present design is the use of a high efficiency material capable of converting battery power to heat in such a design. Such a material provides benefits in heating, particularly in combination with the various elements recited herein including but not limited to the heating element with apertures formed therein, the element gap, and the concentrate pusher.

Thus according to the present design, there is provided a vaporizer, comprising a body, a concentrate chamber provided within the body and comprising at least one chamber aperture, a concentrate pusher configured to push material through the concentrate chamber, a heating element comprising at least one element aperture, the heating element positioned proximate the at least one chamber aperture and configured to heat material pushed through the concentrate chamber, and a power source configured to apply power to the heating element. The apparatus may include a printed circuit board (PCB) configured to control electricity provided between the power source and the heating element, an element gap formed between the heating element and the concentrate chamber, wherein an air passage is formed within the body enabling the user to draw vapor, gas, or aerosol via a mouthpiece provided with the body. The apparatus comprises a power switch configured to effectuate application of electrical power to the heating element. The body may comprise detachable pieces, the concentrate chamber may be provided in a replaceable cartridge. The heating element may be attached to a spring configured to increase distance between the heating element and chamber aperture when pressure is applied to the heating element, at least one chamber aperture comprises a one-way valve, and pressure may be applied to the concentrate pusher by twisting a knob on the apparatus. The heating element may be formed of high-temperature glass coated with a material that converts electrical energy into heat. The material that converts electrical energy into heat may comprise carbon nanotubes or graphene or other material performing this function.

According to a second embodiment, there is provided a method comprising applying pressure to a concentrate pusher to move vaporizable material concentrate from a concentrate chamber through a chamber aperture in a body of a vaporizer toward a heating element; and activating the heating element to heat the vaporizable material concentrate.

According to a further embodiment, there is provided a vaporizer comprising a concentrate pusher configured to push material through a concentrate chamber provided within a vaporizer body, a heating element positioned proximate the concentrate chamber and configured to heat material pushed through the concentrate chamber, and a power source configured to apply power to the heating element.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A vaporizer, comprising:

a body;

a concentrate chamber provided within the body and comprising a chamber aperture;

a heating element positioned proximate the chamber aperture and configured to heat material pushed through the concentrate chamber, the heating element having a disk shape comprising apertures and formed of a temperature resistant material coated with a material capable of converting electrical energy into heat;

a concentrate pusher configured to push material through the concentrate chamber toward the heating element; and a power source configured to apply power to the heating element.

2. The apparatus of claim 1 further comprising a printed circuit board (PCB) configured to control electricity provided between the power source and the heating element.

3. The apparatus of claim 1 wherein an element gap is formed between the heating element and the concentrate chamber.

4. The apparatus of claim 1 wherein an air passage is formed within the body enabling the user to draw vapor, gas, or aerosol via a mouthpiece provided with the body.

5. The apparatus of claim 1 further comprising a power switch configured to effectuate application of electrical power to the heating element.

6. The apparatus of claim 1 wherein the material comprises vaporizable material concentrate.

7. The apparatus of claim 1 wherein the body is comprised of detachable pieces.

8. The apparatus of claim 1 wherein the concentrate chamber is finable with vaporizable material concentrate.

9. The apparatus of claim 1 wherein the concentrate chamber is provided in a replaceable cartridge.

10. The apparatus of claim 1 wherein the heating element is attached to a spring configured to increase distance between the heating element and chamber aperture when pressure is applied to the heating element.

11. The apparatus of claim 1 wherein at least one chamber aperture comprises a one-way valve.

12. The apparatus of claim 1 wherein pressure is applied to the concentrate pusher by twisting a knob on the apparatus.

13. The apparatus of claim 1 wherein the power source comprises a battery.

14. The apparatus of claim 1 wherein the heating element is formed of high-temperature resistant glass.

15. The apparatus of claim 14 wherein the heating element emits sufficient heat to convert vaporizable material concentrate into vapor, gas, or aerosol.

16. A vaporizer, comprising:

a body;

a concentrate chamber provided within the body and comprising at least one chamber aperture;

a concentrate pusher configured to push material through the concentrate chamber;

a heating element comprising at least one element aperture, the heating element positioned proximate the at least one chamber aperture and configured to heat material pushed through the concentrate chamber; and a power source configured to apply power to the heating element;

wherein the heating element is formed of glass coated with a material that comprises carbon nanotubes or graphene.

17. A vaporizer, comprising:

a concentrate pusher configured to push material through a concentrate chamber provided within a vaporizer body;

a heating element positioned proximate the concentrate chamber and configured to heat material pushed through the concentrate chamber by the movable mechanism and the concentrate pusher, wherein the heating element is disk shaped comprising apertures and formed of a temperature resistant material coated with a material capable of converting electrical energy into heat; and a power source configured to apply power to the heating element.

18. The apparatus of claim 17 wherein the heating element is formed of high-temperature resistant glass.

19. The apparatus of claim 17 wherein an air passage is formed within the vaporizer body enabling the user to draw vapor, gas, or aerosol via a mouthpiece provided with the vaporizer body.

20. The apparatus of claim 17 wherein the concentrate chamber comprises vaporizable material concentrate.

* * * * *